US007255460B2

(12) United States Patent
Lee

(10) Patent No.: US 7,255,460 B2
(45) Date of Patent: Aug. 14, 2007

(54) LED ILLUMINATION LAMP

(75) Inventor: Sang Woo Lee, Seoul (KR)

(73) Assignee: Nuriplan Co., Ltd. (KR)

( * ) Notice: Subject to any disclaimer, the term of this patent is extended or adjusted under 35 U.S.C. 154(b) by 32 days.

(21) Appl. No.: 11/269,307

(22) Filed: Nov. 7, 2005

(65) Prior Publication Data

US 2006/0215408 A1 Sep. 28, 2006

(30) Foreign Application Priority Data

Mar. 23, 2005 (KR) ..... 10-2005-0023947
Mar. 23, 2005 (KR) ..... 10-2005-0023948

(51) Int. Cl.
*F21V 29/00* (2006.01)

(52) U.S. Cl. ..... 362/294; 362/231

(58) Field of Classification Search ..... 362/231, 362/294

See application file for complete search history.

(56) References Cited

U.S. PATENT DOCUMENTS 4,729,076 A * 3/1988 Masami et al. ..... 362/235
4,733,335 A * 3/1988 Serizawa et al. ..... 362/503
6,161,910 A * 12/2000 Reisenauer et al. ..... 315/309
6,402,347 B1 * 6/2002 Maas et al. ..... 362/294
6,598,996 B1 * 7/2003 Lodhie ..... 362/249
6,685,339 B2 * 2/2004 Daughtry et al. ..... 362/251
6,786,625 B2 * 9/2004 Wesson ..... 362/545
6,793,374 B2 * 9/2004 Begemann ..... 362/294
6,964,501 B2 * 11/2005 Ryan ..... 362/294
2003/0193816 A1 * 10/2003 Rahn ..... 362/555

FOREIGN PATENT DOCUMENTS

KR 20-0336197 12/2003

* cited by examiner

*Primary Examiner*—Ali Alavi
*Assistant Examiner*—Hargobind S. Sawhney
(74) *Attorney, Agent, or Firm*—Cantor Colburn LLP

(57) ABSTRACT

In addition to the effect of harmonized illumination and increased heat radiation, a LED illumination lamp provides an improved effect of hermetic seal, anti-vibration and waterproofing between components and assures prolonged life span. The illumination lamp comprises a body adapted to be placed on or around a target illumination object, a LED module lying inside the body and a cover mounted on a seat part of the body. The LED module has a printed circuit board affixed to the body and a group of red, green and blue LEDs attached to the printed circuit. The cover is provided with a semitransparent color-producing part capable of harmonizing colors of the light emitted from the LEDs and an air passageway for permitting the heat generated from the LED module to dissipate to the outside.

9 Claims, 9 Drawing Sheets

LED ILLUMINATION LAMP

FIELD OF THE INVENTION

The present invention is directed to a LED illumination lamp for irradiating decorative light on a variety of objects such as bridges, buildings and the like, and more specifically to a LED illumination lamp that has enhanced effect of light decoration, heat dissipation and electric energy saving, while assuring hermetic seal, anti-vibration and waterproofing between lamp components.

BACKGROUND OF THE INVENTION

As is generally known in the art, use has been made of varying kinds of illumination lamps for lightening or illuminating objects at night or indoors. Such illumination lamps are supplied with electric energy from a power source and convert the electric energy to light energy, thereby producing a beam of light for illumination. Typical examples of the illumination lamps include a glow lamp and a fluorescent lamp.

Widely used in recent years is a Light Emitting Diode (LED) illumination lamp that has a benefit of providing illumination of different colors, although higher in price than the typical lamps referred to above. However, the LED illumination lamp poses a drawback in that it tends to be heated up and shows decreased efficiency when used for more than a predetermined time period. Use of the LED lamp for a prolonged period of time may result in excessive heat generation, thus shortening the life span of the lamp.

A number of solutions have been proposed to the problem of excessive heat generation and life span reduction, one example of which is disclosed in Korean Utility Model Registration No. 20-0336197.

A front lightening LED lamp taught in the '197 registration includes, as shown in FIGS. 1*a* and 1*b*, a heat radiation fin 1 having a cylindrical partition wall 1*b* integrally formed with a center part 1*a*, a cooling fan 2 received in the cylindrical partition wall 1*b* of the heat radiation fin 1 for forcibly circulating the air, a circuit board 3 for rectifying alternating current to direct current, a socket 5 attached to the end of the radiation fin 1 and electrically connected to a receptacle for a glow lamp, and a printed circuit board 4 having a plurality of LEDs 4*a* and mounted on the top of the center part 1*a* of the heat radiation fin 1. Each of the LEDs 4*a* is coated with a transparent cover 4*b*. Also provided is a transparent lens 6 that allows light to pass therethrough.

With the construction set forth above, the front lightening LED lamp of the '197 registration can exhibit increased illuminance with reduced energy consumption, provide proper intensity of illumination in compliance with the needs of a user by way of employing a structure that permits the user to directly affix LEDs to the front side of the lamp and thus confining the direction of light irradiation to a frontward direction, and attain cooling efficiency great enough to assure that the cooling fan can fully demonstrate its performance even when in continuous use, thereby extending the life span of the lamp.

The front lightening LED lamp of the '197 registration, however, poses a problem in that it is difficult to illuminate an object with decorative light of different colors because a transparent lens or cover allows the light emitted from LEDs to transmit therethrough without any color variation. Another drawback is that the external appearance of the lamp is marred by the LEDs remaining completely exposed to the outside through the lens. A further shortcoming resides in that the lamp is complicated in structure and costly to manufacture because a separate cooling fan has to be employed to forcibly dissipate the heat generated by the LEDs. Moreover, use of the cooling fan may lead to increased consumption of electric energy and generate additional heat by itself, thus adversely affecting the surrounding components inclusive of LEDs.

In addition to the disadvantages mentioned above, the front lightening LED lamp of the '197 registration has a further problem in that the connection or coupling between lamp components is too weak to provide an acceptable degree of hermetic seal, anti-vibration and waterproofing, which may result in reduced reliability and shortened life span of the lamp.

SUMMARY OF THE INVENTION

Taking into account the above-noted and other problems inherent in the prior art lamps, it is an object of the present invention to provide a LED illumination lamp that can dissipate heat in a natural air circulation manner, allow LEDs to produce harmonized decorative light of different colors, make the external appearance of the lamp simple by prohibiting the LEDs from exposure to the outside through a cover, decrease consumption of electric energy, and enjoy compact overall configuration.

Another object of the present invention is to provide a LED illumination lamp that has an improved effect of hermetic seal, anti-vibration and waterproofing between a base, a LED module and a cover, thereby assuring increased reliability and prolonged life span of the lamp.

With these objects in view, the present invention provides a LED illumination lamp, comprising: a body adapted to be placed on or around an target illumination object, the body having a central bore with an internal fixture shoulder, a seat part provided around a top end of the central bore, a plurality of support ears formed along a periphery of the body at a predetermined spacing, a plurality of heat radiation fins disposed in between the support ears substantially at an equal spacing and a plurality of air vents formed at one side of each of the support ears for allowing air to flow and circulate through the air vents; a LED module having a printed circuit board affixed to the internal fixture shoulder of the body, a group of LEDs attached to the printed circuit board and consisting of red LEDs, green LEDs and blue LEDs, and an electric cable for supplying electric power to the LEDs and control signals to the printed circuit board; and a cover mounted on the seat part of the body, the cover having a semitransparent color-producing part capable of harmonizing colors of the light emitted from the LEDs and prohibiting the LED module from exposure to the outside and an air passageway in communication with interstices existing between the heat radiation fins of the body for permitting the heat generated from the LED module to dissipate to the outside.

According to the LED illumination lamp of the present invention, the semitransparent color-producing part of the cover can harmonize the colors of the light emitted from the LEDs and illuminate a target object with decorative light of different colors. The heat can be dissipated in a natural air circulation manner without having to use any separate cooling means, thereby prolonging the life span of the lamp. The lamp is simple in construction and less costly to manufacture. The external appearance of the lamp becomes sleek and clean by prohibiting the LEDs from exposure to the outside through a cover. Removal of forced heat radiation means decreases consumption of electric energy. The base, the LED module and the cover are coupled together in such a manner as to assure hermetic seal, anti-vibration and waterproofing therebetween, thus increasing the reliability and prolonging the life span of the lamp.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE INVENTION

A preferred embodiment of a LED illumination lamp in accordance with the present invention will now be described in detail with reference to the drawings attached.

Figure 1A:
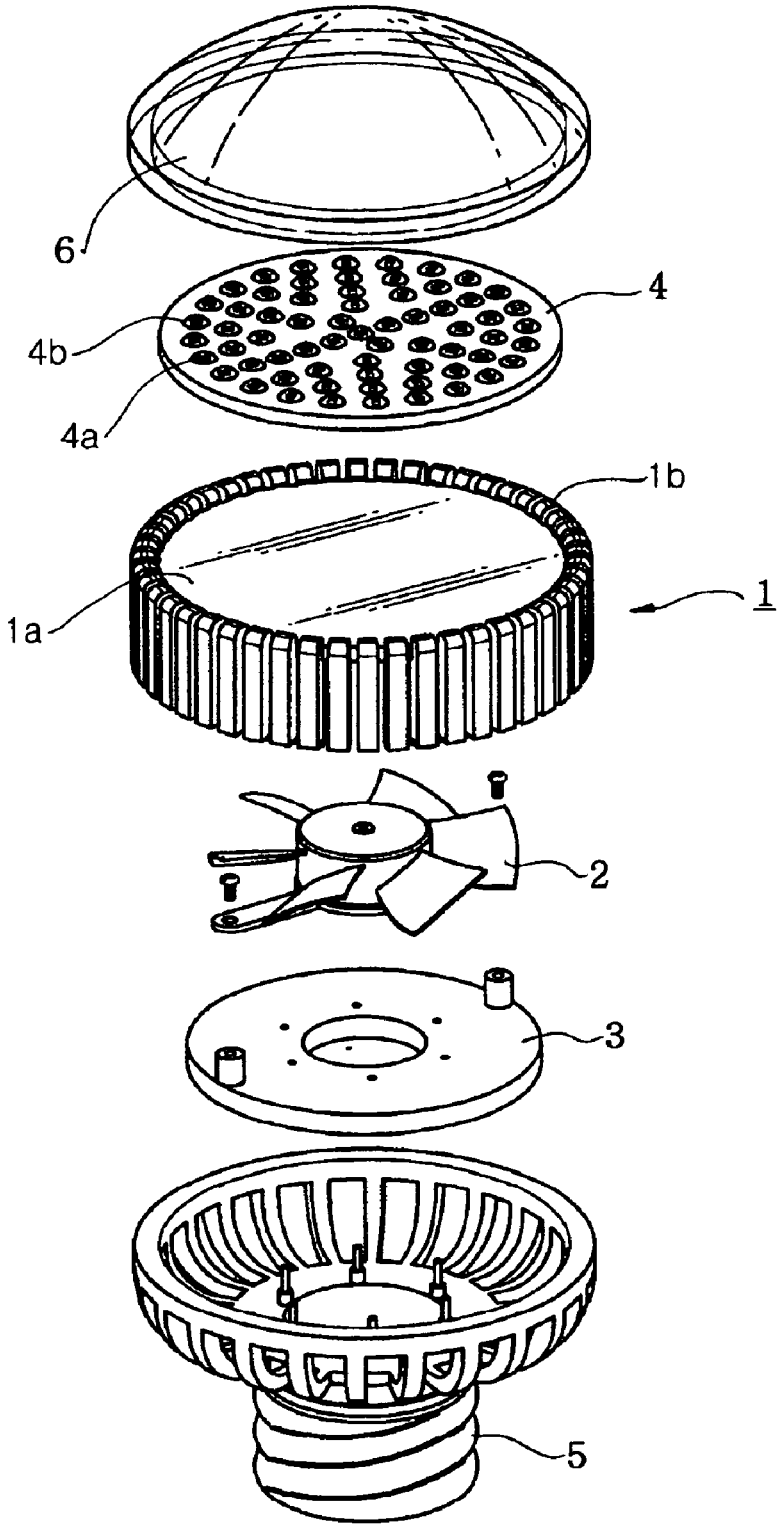
FIG. 1a PRIOR ART
FIGS. 1*a* and 1*b* are exploded perspective view and cross-sectional view showing a prior art illumination lamp disclosed in Korean Utility Model Registration No. 20-0336197.
Figure 1B:
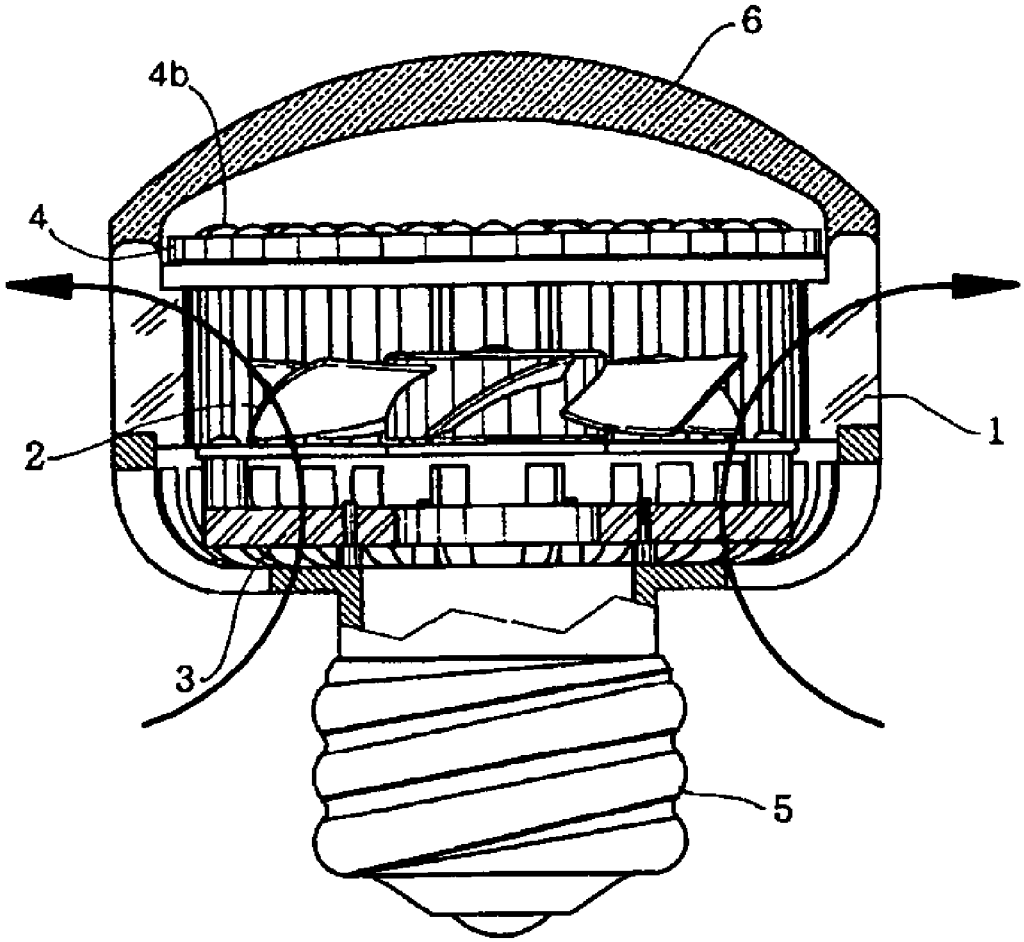
FIG. 1b PRIOR ART
Figure 2:
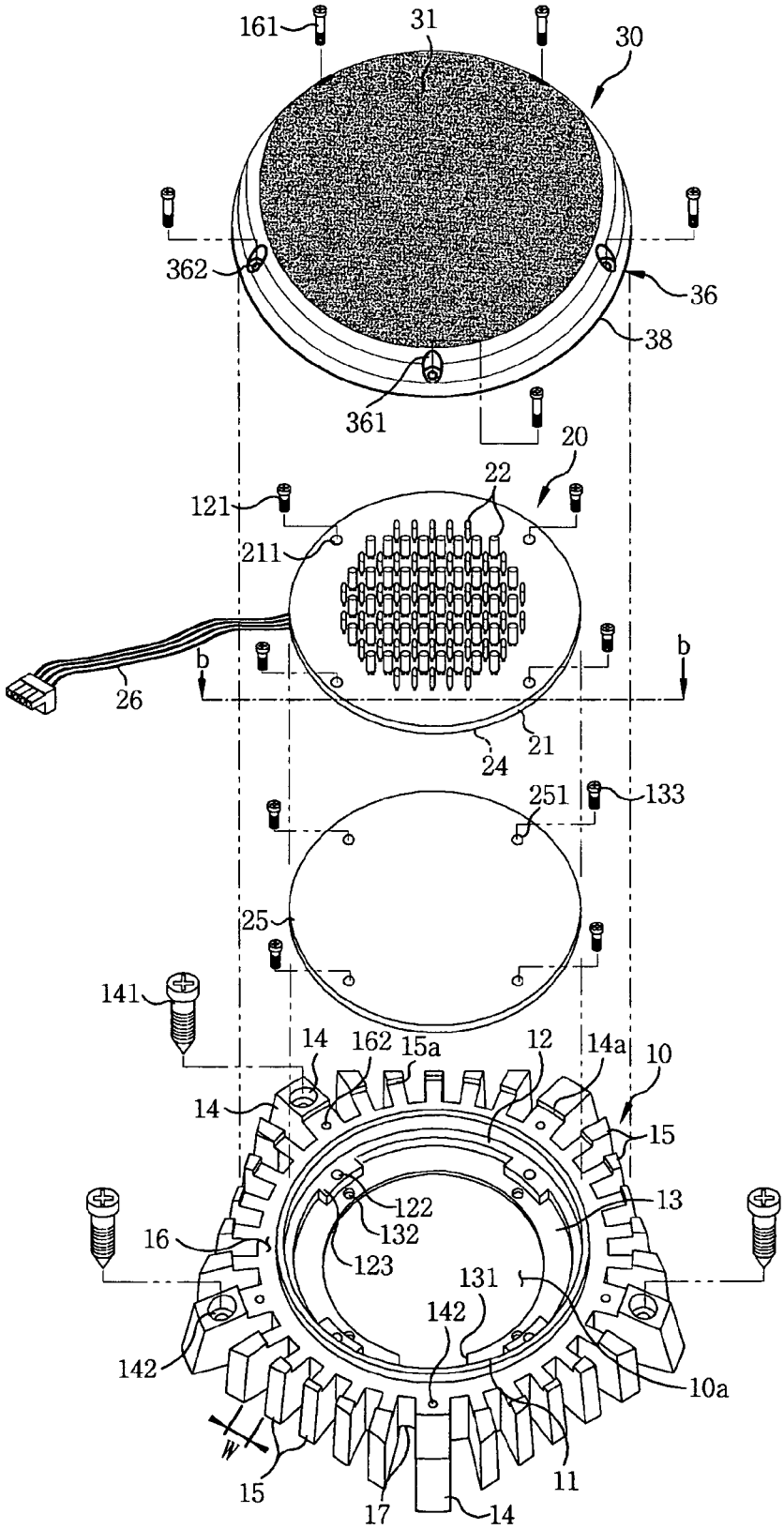
FIG. 2 is an exploded perspective view illustrating a LED illumination lamp in accordance with the present invention.
Figure 3:
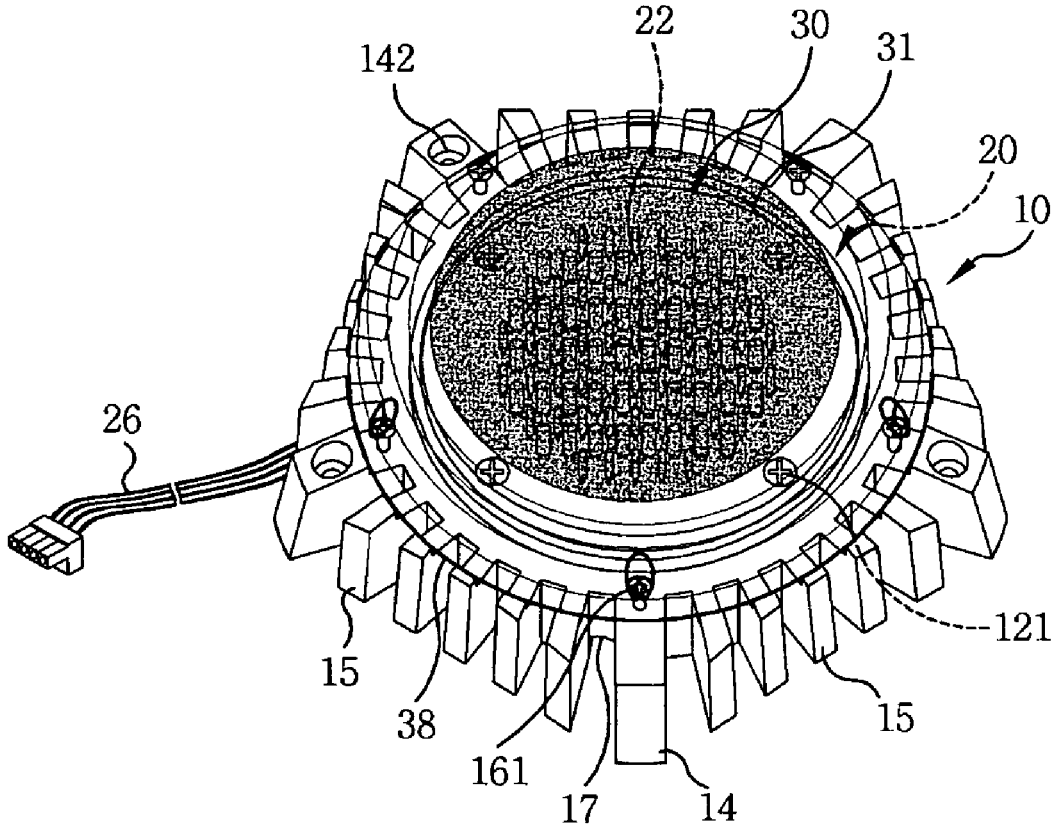
FIG. 3 is a perspective view of the LED illumination lamp shown in FIG. 2, with their components coupled together.
Figure 4:
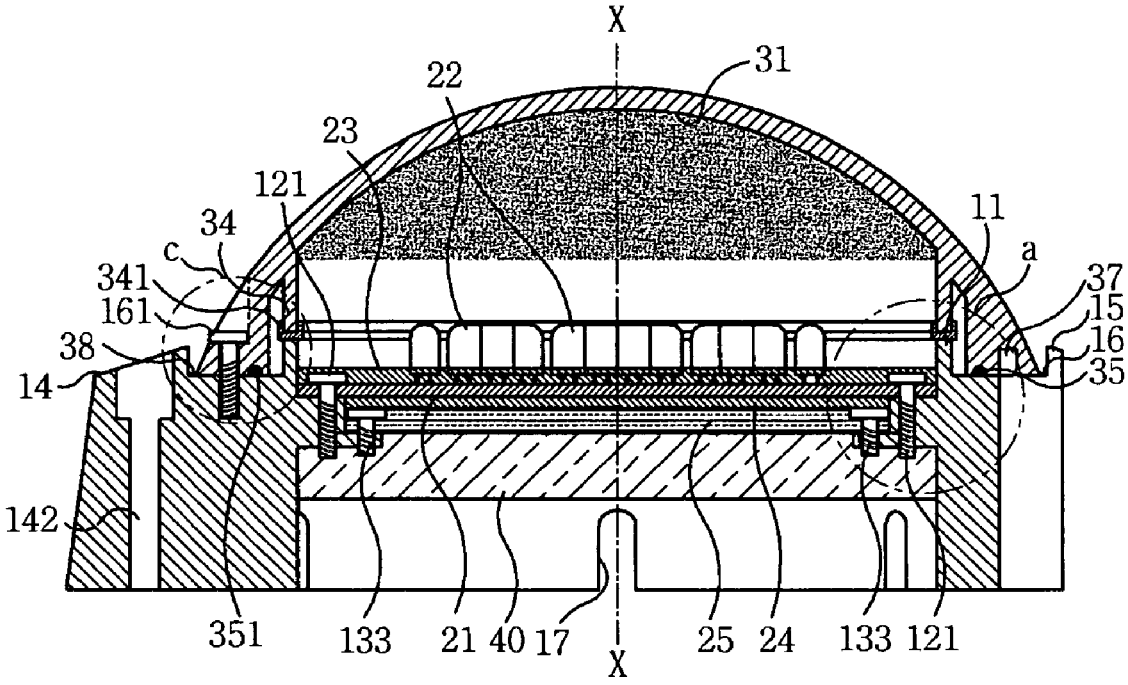
FIG. 4 is a front sectional view of the LED illumination lamp shown in FIG. 2.
Figure 5A:
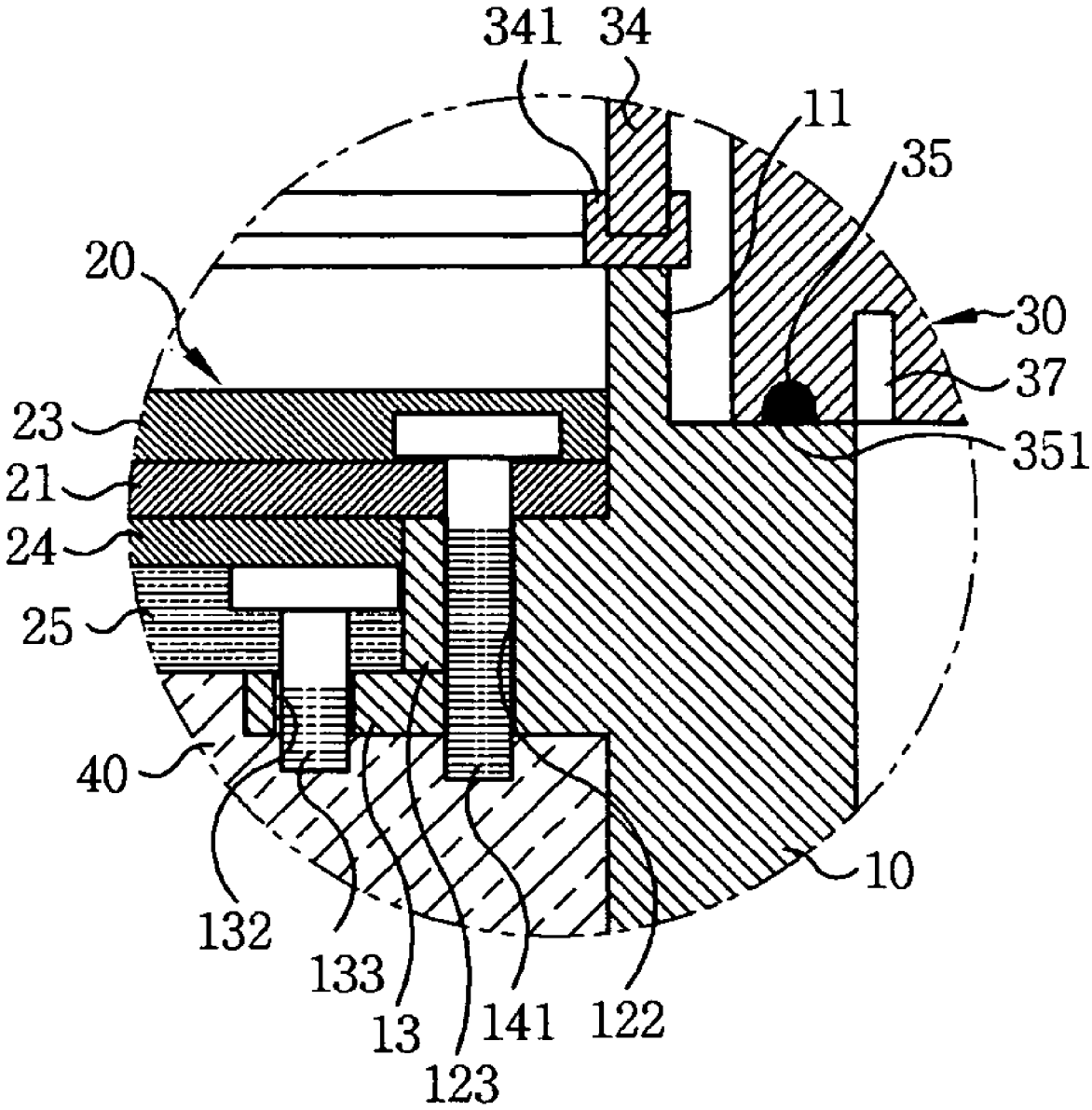
FIG. 5*a* is a partially enlarged sectional view of "a" part in FIG. 4.
Figure 5B:
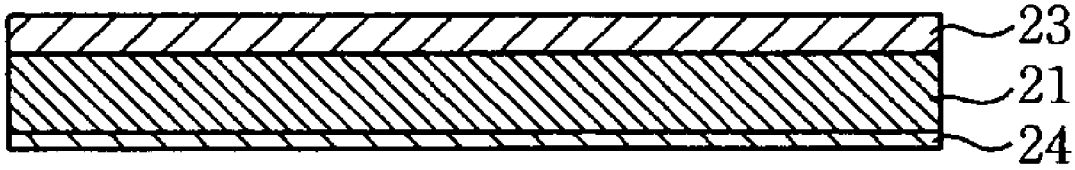
FIG. 5*b* is a partially enlarged sectional view taken along line "b-b" in FIG. 2, and FIG. 5*c* a partially enlarged sectional view of "c" part in FIG. 4.
Figure 5C:
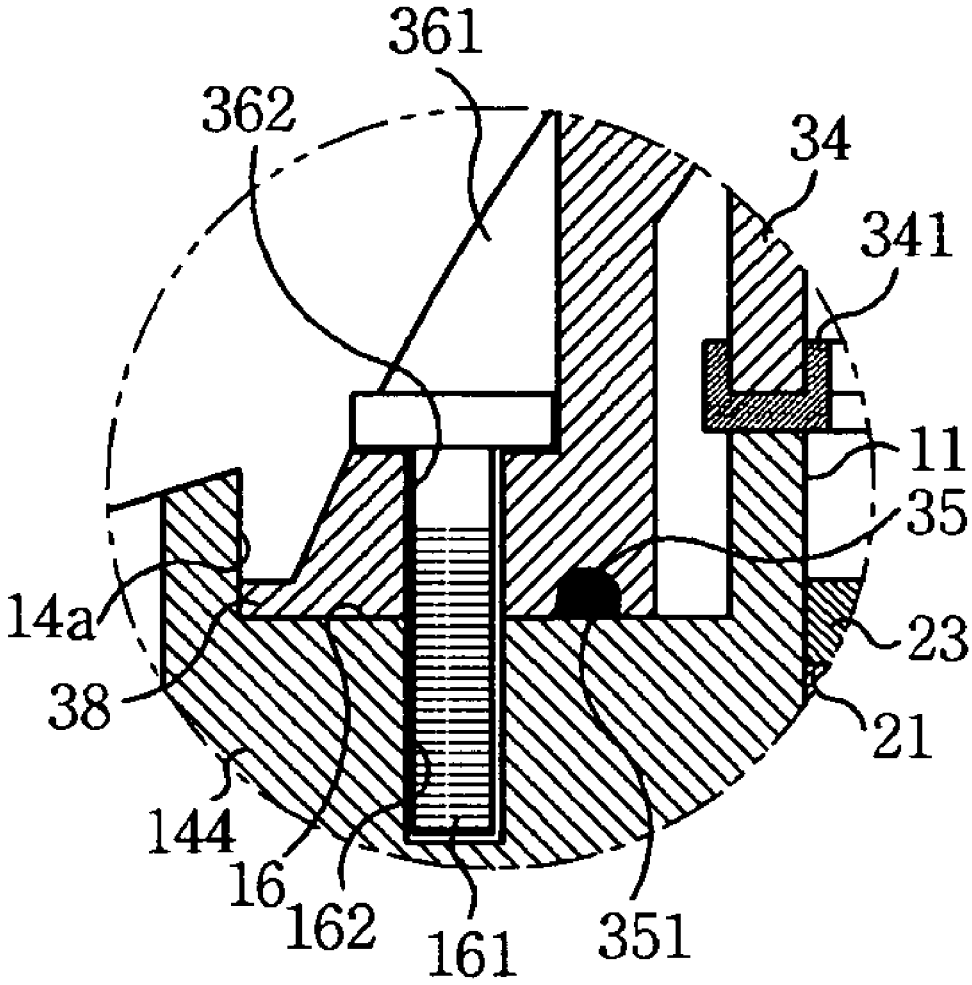
Figure 6:
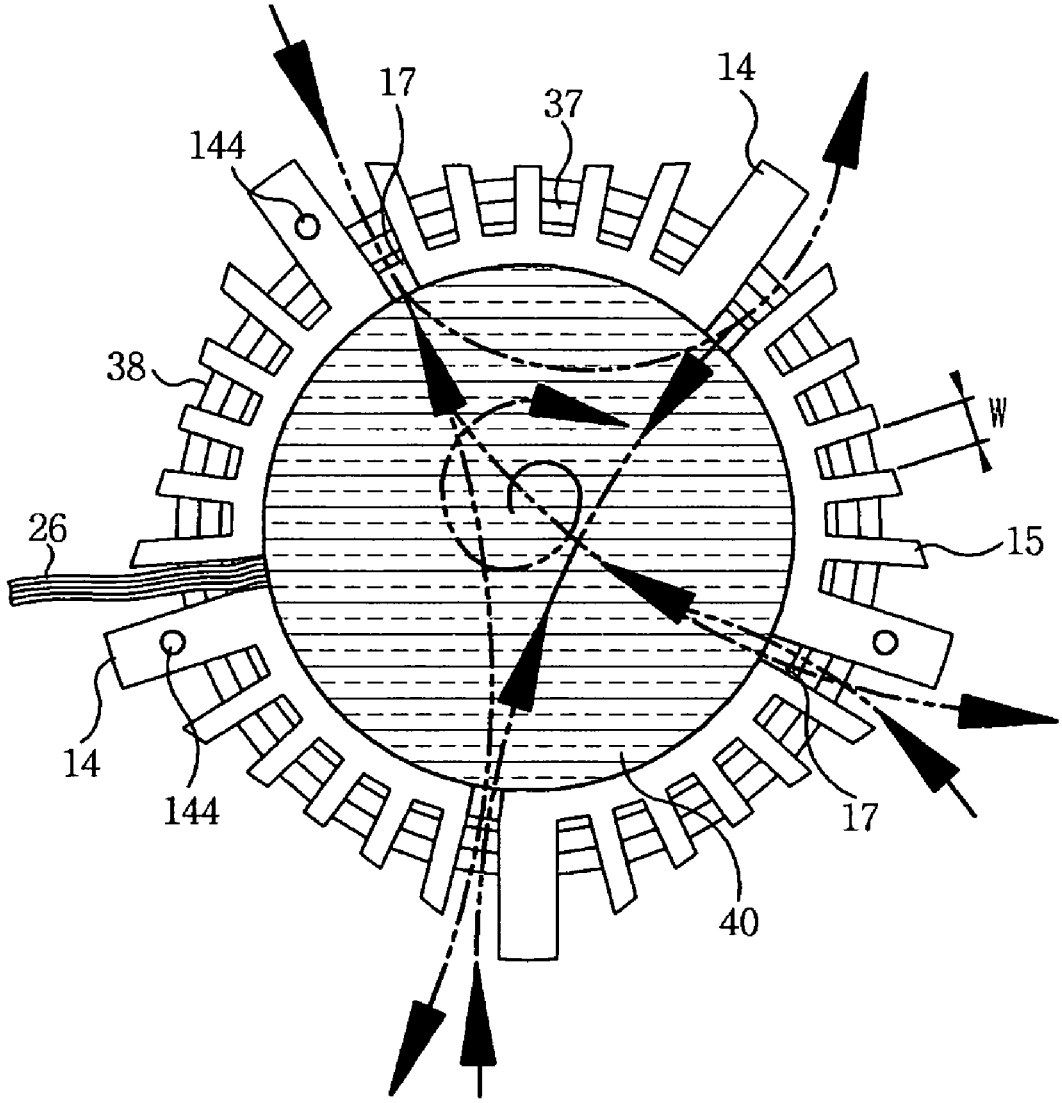
FIG. 6 is a bottom view depicting air circulation in the LED illumination lamp in accordance with the present invention.

FIG. 2 is an exploded perspective view illustrating a LED illumination lamp in accordance with the present invention; FIG. 3 is a perspective view of the LED illumination lamp shown in FIG. 2, with their components coupled together; FIG. 4 is a front sectional view of the LED illumination lamp shown in FIG. 2; FIGS. 5*a*, 5*b* and 5*c* are partially enlarged sectional views showing the structural relationship of a body, a LED module and a cover; and FIG. 6 is a bottom view depicting air circulation in the LED illumination lamp in accordance with the present invention.

Referring to FIGS. 2 through 6, designated by reference numeral 10 is a body that can be placed or installed on or around a target illumination object. The body 10 may be produced by virtue of, e.g., die casting of aluminum which is lightweight and exhibits good performance of heat radiation. A so-called anode oxidation film is formed on the entire surface of the body 10 through an anodizing process to prevent oxidation of the body and improve durability thereof.

The body 10 has at its center a bore 10*a* of predetermined diameter extending along a center axis X-X as best shown in FIG. 4. An annular border part 11 protrudes in an upward direction generally in a flush relationship with the bore 10*a*. Radially inwardly extending from the bore 10*a* is a fixture shoulder 12 that serves to support a printed circuit board of a LED module set forth below. A plurality of fixing lugs 123 protrudes radially inwardly toward the center axis X-X, each of the fixing lugs 123 having a thread hole 122 through which a bolt 121 is fastened to affix the printed circuit board of the LED module.

Formed below the fixture shoulder 12 is a support shoulder 13 that holds and supports a heat radiation plate described below. The support shoulder 13 is spaced apart from the fixture shoulder 12 and protrudes radially inwardly toward the center axis X-X with a predetermined width. Particularly, the support shoulder 13 has a cutout 131 through which an electric cable for supplying electric current to the printed circuit board extends with no interference with the support shoulder 13 or the body 10. The support shoulder 13 is also provided with through-holes 132 for allowing bolts 133 to pass therethrough in order to fasten the heat radiation plate in place.

Five support ears 14 protrude radially outwardly from and are disposed along the periphery of the body 10 at an angular spacing of about 72 degrees. Formed on at least three of the support ears 14 are thread holes 142 through which bolts 141 are tightened to fasten the body 10, i.e., the lamp in an appropriate position for illumination.

A plurality of radially outwardly protruding heat radiation fins 15 are disposed in between the support ears 14 so that they can dissipate the heat generated by the LEDs set forth below. The heat radiation fins 15 are spaced apart from one another substantially at an equal spacing (W), assuring that the ambient air can flow and circulate through between the respective heat radiation fins 15 to thereby cool down the body 10. Although the heat radiation fins 15 disposed between two neighboring support ears 14 are five in number in the present embodiment, the number of the heat radiation fins 15 may be greater or smaller as far as the rigidity of the body is kept intact.

On the top surface of the body 10, a planar seat part 16 is provided between the annular border part 11 and the top surfaces of the support ears 14 and the heat radiation fins 15 such that the below-noted cover can be stably placed on the seat part 16. The top surfaces of the support ears 14 and the heat radiation fins 15 are provided with step portions 14*a* and 15*a* which form the seat part 16. Formed on each of the step portions 14*a* of the support ears 14 is a thread hole 162 with which a bolt 161 is threadedly engaged to fasten the below-mentioned cover in place.

A plurality of air vents 17 are formed at one side of each of the support ears 14 on the bottom side of the body 10 for allowing the ambient air to flow and circulate through the air vents 17 to thereby efficiently remove the heat generated by the LEDs. Although the air vents 17 are five in number and disposed at one side of each of the support ears 14 in the present embodiment, the number and position of the air vents 17 may be changed properly depending on the size of the body and the environment of use of the lamp.

Designated by reference numeral 20 is a LED module for producing light for illumination. The LED module 20 is provided with a printed circuit board 21 of circular configuration which is inserted within the annular border part 11. Formed through the printed circuit board 21 are a number of through-holes 211, each of which is aligned with the corresponding thread hole 122 of the fixing lugs 123 on the fixture shoulder 12 of the body 10 so that the bolt 121 can be inserted therethrough. No electric circuit is formed around the through-holes 211 of the printed circuit board 21 to electrically isolate the board 21 from the bolt 121 and the body 10.

A group of LEDs 22 is attached to the printed circuit board 21. The group of LEDs 22 consists of red LEDs, green LEDs and blue LEDs which are designed to produce decorative light of different colors. The group of LEDs 22 is preferably energized by electricity of less than 12 W in order to save the electric energy and reduce the cost for illumination.

A coat layer 23 of predetermined thickness is provided on the top surface of the printed circuit board 21 of the LED module 20 for the sake of waterproofing, insulation and light reflection. The coat layer 23 can be formed by way of fixedly securing the LED module 20 to the fixture shoulder 12 of the body 20 through the use of the bolt 121 and then applying coat material on the entire surface of the printed circuit board 21. Preferably, white epoxy is used as the coat material for the coat layer 23 so that the light emitted from the group of LEDs can be reflected with an increased illuminance.

Moreover, an insulation film 24 is bonded to the rear surface of the printed circuit board 21 of the LED module 20 for insulating the printed circuit board 21 from the body 10, while blocking and absorbing external shocks to protect the LED module 20. The insulation film 24 is made of such insulating materials as polyamide, polyester, polyimide, glass epoxy and the like, which can provide effective insulation, increased light transmissivity and easy extrusion and injection.

A heat radiation plate 25 of excellent heat conductivity is attached to the bottom surface of the printed circuit board 21 so that the heat generated from the group of LEDs 22 can be conducted to the outside through the heat radiation plate 25. The heat radiation plate 25 has insert holes 251 formed in alignment with the through-holes 132 of the support shoulder 13 and can be secured to the support shoulder 13 of the body 10 by tightening the bolt 132 through the insert holes 251 and the through-holes 132.

Connected to printed circuit board 21 is an electric cable 26 through which electric current is supplied to the printed circuit board 21 and the group of LEDs 22. The electric cable 26 is also coupled to a controller (not shown) that serves to control the operation of the group of LEDs 22 in a predetermined manner. The electric cable 26 extends to the outside through the cutout 131 of the support shoulder 13 and one of the air vents 17 adjacent to the cutout 131 with no interference with the body 10.

Designated by reference numeral 30 is a cover that functions to shield the top portion of the body 10 and the LED module 20 and has the capability of harmonizing the light emitted from the group of LEDs 22 to produce decorative light of different colors. The cover 30 may be made of, e.g., polycarbonate, which has increased durability and can prevent the cover 30 from damage by external shocks and positively protect the group of LEDs 22.

In particular, the cover 30 is adapted to harmonize the lights of red (R), green (G) and blue (B) colors, which are emitted from the group of LEDs 22 under a given program, and produce decorative light of different color combination to provide desired illumination. The cover 30 is provided with a semitransparent color-producing part 31 that can prevent scattering of light to lessen the eye strain and prohibit the group of LEDs 22 and other components from exposure to the outside in an effort not to mar the aesthetic appearance and the feeling of texture of the cover 30. It would be preferred that the color-producing part 31 is formed through the use of a mold whose surface is treated by sanding, knurling or sandblasting.

The color-producing part 34 of the cover 30 is provided on its bottom side with a vertically downwardly extending cylindrical protrusion 34 corresponding to the annular border part 11 of the body 10. The cylindrical protrusion 34 has a gasket 341 whose cross-section is of "U"-shape so that it can be firmly held in place by the cylindrical protrusion 34. The gasket 341 is kept in pressurized sealing contact with the border part 11 of the body 10 to provide the effect of gas-proofing, water-proofing and anti-vibration.

The cover 30 is provided on its bottom periphery with an edge rim 38 that makes close contact with the seat part 16 of the body 10 and the step portions 14*a*, 15*a* of the support ears 14 and the heat radiation fins 15. A reception groove 35 is formed along a bottom end of the edge rim 38 of the cover 30 and an 0-shaped seal ring 351 is fitted to the reception groove 35, the seal ring 351 making air-tight contact with the seat part 16 of the body 10.

The cover 30 has a plurality of fastening parts 36 disposed along a periphery of the cover 30. Each of the fastening parts 36 cooperates with a bolt 161 to fasten the cover 30 to the body 10 and consists of a guide recess 361 for receiving and guiding the bolt 161 and a through-hole 362 adjoining to the guide recess 361 and in alignment with the thread hole 162 formed through the seat part 16 of the body 10 for allowing the bolt 161 to be inserted therethrough.

An air passageway 37 is formed in the vicinity of the seat part 16 of the body 10 and remains in communication with interstices existing between the heat radiation fins 15 of the body 10. The air passageway 37 permits the ambient air to flow and circulate therethrough, thereby dissipating the heat generated from the LED module 20 and conducted to the border rim 11 of the body 10 and the bottom of the cover 30.

Reference numeral 40 designates a protection layer that serves to shield and protect the interior of the body 10 and the bottom side of the illumination lamp. The protection layer 40 is formed for the purpose of waterproofing by molding, e.g., epoxy resin or silicon resin and has black color to avoid reflection of light. Needless to say, the protection layer 40 has such a thickness as not to close the air vents 17 of the body 10.

Description will now shifted to fabrication and operation of the LED illumination lamp in accordance with present invention. 5 The heat radiation plate 25 is placed on the support shoulder 13 of the body 10 and secured by the bolt 133. Then, the LED module 20 inserted within the border rim 11 of the body 10 so that the printed circuit board 21 can be positioned on the fixture shoulder 12.

The bolt 121 is inserted through the through-hole 211 of the printed circuit board 21 and tightened into the thread hole 122 of the fixing lugs 123 of the fixture shoulder 12 to 1 0 thereby fasten the LED module 20 to the body 10.

Under that state, a coat layer 23 of uniform thickness is formed on the top surface of the printed circuit board 21 by depositing white epoxy resin. This is to protect terminals of the respective LEDs 22 and provide the effect of enhanced waterproofing, insulation and light reflection. 15 Subsequently, the cover 30 is placed on the seat part 16 of the body 10, after which the bolt 161 is inserted through the guide recess 361 and the through-hole 362 of each of the fastening parts 36 and tightened into the thread hole 162 of each of the support ears 14, thereby fastening the cover 30 to the body 10. In this state, the edge rim 38 formed on the bottom periphery of the cover 30 makes gap-free contact with the outer circumferential 20 area of the seat part 16, the step portions 14*a* of the support ears 14 and the step portions 15*a* of the heat radiation fins 15. The gasket 341 held by the cylindrical protrusion 34 of the cover 30 is brought into air-tight contact with the border rim 11 of the body 10, whereas the seal ring 351 fitted into the reception groove 35 of the cover 30 is in close air- tight contact with the seat part 16 of the body 10. This helps maintain firm fitting and 25 coupling state, while providing the effect of increased anti-vibration and water-proofing.

The final step is to form the protection layer 40 on the bottom interior of the body 10 by molding epoxy resin or silicon resin. The thickness of the protection layer 40 should be limited to a size small enough not to close the air vents 17 of the body 10.

The LED illumination lamp thus fabricated is installed at a proper position on or 30 around the target illumination object. By turning on the LED illumination lamp, it becomes possible to illuminate the target object with decorative light of different color combination. Specifically, electric power and control signals are supplied to the LED module 20 from a controller not shown in the drawings, in response to which the LEDs 22 emit light of red (R), green (G) and blue (B) color, a part or all of which light is properly harmonized in the color-producing part 31 of the cover 30 and then directed to the outside, thus providing illumination of varying colors.

In addition, the light emitted from the respective LEDs 22 is reflected by the coat layer 23 of the printed circuit board 21, assuring that a greater amount of light can be directed to the target object whereby the target object can be illuminated with reduced electric power and increased illuminance.

In the meantime, a part of the heat generated by the LEDs 22 in the course of such illumination is dissipated to the outside through the cover 30, another part of the heat is dissipated through the body 10 and the heat radiation fins 15 to the outside and a further part of the heat is dissipated through the printed circuit board 21 and the heat radiation plate 25 to the outside.

Particularly, the heat can be effectively dissipated to the outside from the underneath of the cover 30 by the air circulating through the air passageway 37 in communication with the interstices between the heat radiation fins 15. In addition to the dissipation in the heat radiation fins 15, the heat can be effectively dissipated by the air circulating through the air vents 17 formed at one side of each of the support ears 14.

Moreover, the gasket 341 held by the cylindrical protrusion 34 of the cover 30 is brought into closet contact with the border rim 11 of the body 10, the seal ring 351 fitted into the reception groove 35 of the cover 30 is in close air-tight contact with the seat part 16 of the body 10, and the edge rim 38 formed on the bottom periphery of the cover 30 makes gap-free contact with the outer circumferential area of the seat part 16, the step portions 14*a* of the support ears 14 and the step portions 15*a* of the heat radiation fins 15. This prevents unwanted loosening of the cover 30 and improves the effect of waterproofing and anti-vibration between the body 10 and the cover 30.

The black protection layer 40 molded on the bottom interior of the body 10 can positively protect the components received in the body 10 and enhance the waterproofing of the illumination lamp.

Furthermore, the illumination lamp can be installed at many different positions in varying fashions, thanks to the reduced overall height or thickness, and the electric power can be saved because no power cooling means is employed and the electricity is consumed by the LEDs alone.

The semitransparent color-producing part 31 of the cover 30 is capable of harmonizing the light emitted from the LEDs 22 and producing decorative light of varying color combination. Even when the LEDs 22 are turned off, the LEDs 22 and other components are not exposed to the outside, thus improving aesthetic appearance of the illumination lamp.

Particularly, since the body 10, the LED module 20 and the cover 30 are fitted and coupled together in an air-tight manner, the anti-vibration and waterproofing effect is greatly improved, resulting in prolonged life span of the illumination lamp.

As described in the foregoing, the present invention provides a variety of beneficial effects in that the LED illumination lamp can produce harmonized decorative light of different colors, can dissipate heat in a natural air circulation manner without having to use any separate power cooling means, and can fit a base, a LED module and a cover together in such a fashion as to assure improved hermetic seal, anti-vibration and waterproofing, thereby increasing reliability and prolonging life span of the illumination lamp.

Although certain preferred embodiments of the present invention have been described in detail, it will be apparent to those skilled in the art that various changes or modifications may be made thereto within the scope of the invention defined by the appended claims.

What is claimed is:

1. A LED illumination lamp, comprising:

a body adapted to be placed on or around an target illumination object, the body having a central bore with an internal fixture shoulder, a seat part provided around a top end of the central bore, a plurality of support ears formed along a periphery of the body at a predetermined spacing, a plurality of heat radiation fins disposed in between the support ears substantially at an equal spacing and a plurality of air vents formed at one side of each of the support ears for allowing air to flow and circulate through the air vents;

a LED module having a printed circuit board affixed to the internal fixture shoulder of the body, a group of LEDs attached to the printed circuit board and consisting of red LEDs, green LEDs and blue LEDs, and an electric cable for supplying electric power to the LEDs and control signals to the printed circuit board; and a cover mounted on the seat part of the body, the cover having a semitransparent color-producing part capable of harmonizing colors of the light emitted from the LEDs and prohibiting the LED module from exposure to the outside and an air passageway in communication with interstices existing between the heat radiation fins of the body for permitting the heat generated from the LED module to dissipate to the outside.

2. The LED illumination lamp as recited in claim 1, wherein the cover is provided with a plurality of fastening parts disposed along a periphery of the cover, each of the fastening parts consisting of a guide recess for receiving and guiding a bolt and a through-hole adjoining to the guide recess and in alignment with a thread hole formed through the seat part of the body for allowing the bolt to be inserted therethrough.

3. The LED illumination lamp as recited in claim 1, wherein the support ears are spaced apart at an angular spacing of 72 degrees, the cover is made of polycarbonate resin, and the color-producing part of the cover is formed by a sandblasted mold.

4. The LED illumination lamp as recited in claim 1, wherein a white epoxy layer is coated on a top surface of the printed circuit board of the LED module for the sake of waterproofing, insulation and light reflection.

5. The LED illumination lamp as recited in claim 1, wherein a heat radiation plate is attached to a bottom surface of the printed circuit board and secured to the internal fixture shoulder of the body so that the heat generated from the LEDs can be conducted to the outside through the heat radiation plate.

6. The LED illumination lamp as recited in claim 1, wherein the color-producing part of the cover is provided on its bottom side with a cylindrical protrusion corresponding to an annular border part of the body, the cylindrical protrusion having a gasket kept in sealing contact with the border part of the body, and the cover is provided on its bottom periphery with an edge rim making close contact with the seat part of the body and the top surfaces of the support ears and the heat radiation fins.

7. The LED illumination lamp as recited in claim 6, wherein a reception groove is formed along a bottom end of the edge rim of the cover and an O-shaped seal ring is fitted to the reception groove, the seal ring making air-tight contact with the seat part of the body.

8. The LED illumination lamp as recited in claim 1, wherein an epoxy protection layer of black color is provided on an inner bottom side of the body for the purpose of waterproofing, light-shielding and concealment of components.

9. The LED illumination lamp as recited in claim 1, wherein an insulation film is bonded to a rear surface of the printed circuit board of the LED module for insulating the printed circuit board from the body and the heat radiation plate.

* * * * *